US008317296B2

(12) United States Patent
Shiota

(10) Patent No.: US 8,317,296 B2
(45) Date of Patent: Nov. 27, 2012

(54) RECORDING APPARATUS

(75) Inventor: Takayuki Shiota, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 192 days.

(21) Appl. No.: 12/848,299

(22) Filed: Aug. 2, 2010

(65) Prior Publication Data

US 2011/0032305 A1 Feb. 10, 2011

(30) Foreign Application Priority Data

Aug. 4, 2009 (JP) ..... 2009-181277

(51) Int. Cl.
*B41J 2/165* (2006.01)

(52) U.S. Cl. ..... 347/35

(58) Field of Classification Search ..... None
See application file for complete search history.

(56) References Cited

U.S. PATENT DOCUMENTS

| | | | | |
|---|---|---|---|---|
| 6,910,757 | B2 | 6/2005 | Kanamitsu et al. | |
| 6,938,998 | B2 | 9/2005 | Morikoshi | |
| 7,404,619 | B2 * | 7/2008 | Tamai et al. | 347/36 |
| 7,427,131 | B2 | 9/2008 | Okamoto et al. | |
| 2007/0236535 | A1 * | 10/2007 | Baker et al. | 347/36 |

FOREIGN PATENT DOCUMENTS

| | | |
|---|---|---|
| JP | 2004-001485 | 1/2004 |
| JP | 2004-009700 | 1/2004 |
| JP | 2004-136667 | 5/2004 |

* cited by examiner

*Primary Examiner* — Matthew Luu
*Assistant Examiner* — Alejandro Valencia
(74) *Attorney, Agent, or Firm* — Workman Nydegger

(57) ABSTRACT

A recording apparatus includes: a recording head that ejects ink; a sheet material that receives ink discarded from the recording head directly from the recording head or indirectly via another member; an ink absorption material that absorbs ink, and includes an ink absorption surface that forms a surface that intersects with an ink receiving surface of the sheet material that receives ink, and faces the ink receiving surface; and a sheet material movement unit that causes the sheet material to slide in at least a direction in which the ink receiving surface approaches the ink absorption surface.

5 Claims, 9 Drawing Sheets

RECORDING APPARATUS

BACKGROUND

1. Technical Field

The present invention relates to recording apparatuses such as facsimile machines, printers, and the like, and relates particularly to recording apparatuses provided with an ink absorption material that absorbs ink discarded (uselessly ejected) from a recording head.

2. Related Art

Hereinafter, an ink jet printer will be given as a specific example of a recording apparatus, which is typically exemplified by facsimile devices, printers, and so on. Some ink jet printers are configured so as to be capable of executing what is known as borderless recording, in which recording is performed without white margins on the four sides of recording paper in order to obtain output results similar to silver halide photographs.

With an ink jet printer capable of executing such borderless recording, ink is also ejected onto regions that are outside of the edges of the recording paper (that is, ink is discarded (uselessly ejected) hereinafter called "discarded"). Accordingly, a concave portion is formed in a paper support member that is provided opposite to an ink jet recording head and that regulates the distance between the recording paper and the ink jet recording head by supporting the recording paper, the concave portion being formed in a region of the paper support member where ink is discarded.

An ink absorption material that absorbs the discarded ink is disposed in this concave portion, and a discharge hole that discharges the ink absorbed by the ink absorption material downward is formed at the base of the concave portion. Through this, the ink absorbed by the ink absorption material is discharged from the discharge hole toward a waste liquid tray disposed therebelow.

Meanwhile, regardless of borderless recording, ink jet printers are often provided with a discard region for discarding ink (for example, an ink discarding hole for flushing operations (empty ejection)). Ink that has been discarded in the ink discard region is, in the same manner as described above, discharged toward the waste liquid tray.

An ink absorption material that absorbs ink is disposed within this waste liquid tray, and thus the ink does not leak out from the waste liquid tray even if the apparatus is tilted, thereby holding the ink within the waste liquid tray (for example, see JP-A-2004-9700).

Incidentally, pigment-based inks and dye-based inks exist as inks that are ejected by ink jet recording heads, and by nature, a pigment-based ink does not permeate well into an ink absorption material. Accordingly, depending on a situation, the ink cannot completely permeate into the ink absorption material, and hardens on the surface of the ink absorption material as a result; as this process is repeated, hardened ink gradually accumulates on the surface of the ink absorption material.

The amount of accumulated hardened ink will increase until eventually it reaches the back surface of recording paper supported by a paper support member, and there is thus the risk that the back surface of the recording paper will be soiled, resulting in a remarkable drop in the recording quality. Such problems are not limited to the ink absorption material disposed on the paper support member that supports the recording paper, but also occur in the ink absorption material disposed below the paper support member.

SUMMARY

An advantage of some aspects of the invention is to provide a recording apparatus capable of accelerating the permeation of discarded ink into an ink absorption material and preventing or retarding the accumulation of ink, even in the case where an ink that does not permeate easily into the ink absorption material (for example, a pigment-based ink) is used.

A first aspect of the invention is a recording apparatus including: a recording head that ejects ink; a sheet material that receives ink discarded from the recording head directly from the recording head or indirectly via another member; an ink absorption material that absorbs ink, and includes an ink absorption surface that forms a surface that intersects with an ink receiving surface of the sheet material that receives ink, and faces the ink receiving surface; and a sheet material movement unit that causes the sheet material to slide in at least a direction in which the ink receiving surface approaches the ink absorption surface.

According to this aspect, the configuration is such that ink discarded from the recording head adheres to (drops onto) the ink receiving surface of the sheet material, directly from the recording head or indirectly via another member. The ink absorption surface (wall surface) formed with the ink absorption material and that configures a surface intersecting with the ink receiving surface faces this ink receiving surface, and as a result of the sheet material being slid by the sheet material movement unit, ink that has accumulated on the ink receiving surface is pushed against the ink absorption surface.

In other words, due to this configuration, the ink is rather forcefully caused to permeate into the ink absorption material, thereby making it possible to accelerate the permeation of the ink into the ink absorption material and achieve favorable permeability even when inks of high viscosity are used.

A second aspect of the invention is the first aspect, in which a through-hole that passes through the ink absorption material in the thickness direction thereof is formed in the ink absorption material, and the ink absorption surface is formed by the inner circumferential surface of the through-hole.

According to this aspect, the ink absorption surface is formed by the inner circumferential surface of the through-hole formed in the ink absorption material, and thus the periphery of the ink receiving surface of the sheet material is surrounded by the ink absorption surface; this makes it possible to cause ink to be absorbed regardless of in which direction the sheet material is slid, thereby making it possible to cause the ink to be absorbed efficiently.

A third aspect of the invention is the first or the second aspect, in which a recording target medium support member that is disposed opposite to the recording head and that regulates the distance between a recording target medium and the recording head by supporting the recording target medium is further provided, and in which a concave portion into which ink is discarded and an ink discharge hole that is formed in the bottom surface of the concave portion and that discharges ink downward are formed in the recording target medium support member, the ink absorption material and the sheet material are disposed below the recording target medium support member, and the ink receiving surface of the sheet material and the ink discharge hole are connected by an ink conduction member that conducts ink.

According to this aspect, the following effects can be obtained in a configuration in which ink ejected from the recording head is collected via the recording target medium support member by the sheet material and the ink absorption material disposed below the recording target medium support member. In other words, because the ink discharge hole formed in the recording target medium support member and the ink receiving surface (sheet material) are connected by the ink conduction member, ink is conducted (discharged) to the ink receiving surface in a smooth manner from the recording target medium support member.

Then, when the sheet material moves, the ink that has accumulated at the lower end of the ink conduction member leaks out to the outside thereof as a result of the movement, and then moves to the ink absorption material (the ink absorption surface). Accordingly, as a result, the ink can be conducted from the ink conduction member to the ink absorption material in a smooth manner.

A fourth aspect of the invention is one of the first through the third aspects, in which the sheet material movement unit includes a configuration that slides the sheet material using a motor.

According to this aspect, the sheet material movement unit includes a configuration for sliding the sheet material using a motor, and it is thus possible to slide the sheet material at any appropriate timing; for example, by sliding the sheet material immediately after recording operations, flushing operations, or the like have ended, ink can be caused to be absorbed into the ink absorption material with certainty before accumulated ink hardens upon the ink receiving surface.

A fifth aspect of the invention is one of the first through the third aspects, in which a tray is provided so as to be capable of assuming an opened state and a closed state by being rotated, and when in the opened state, the tray receives the recording target medium onto which recording has been performed and that has been discharged, and the sheet material movement unit includes a configuration that slides the sheet material in accordance with the rotation of the tray.

According to this aspect, the sheet material movement unit includes a configuration that slides the sheet material in accordance with the rotation of the tray; accordingly, a dedicated driving source for the sheet material movement unit is unnecessary, thereby making it possible to reduce the cost of the apparatus.

A sixth aspect of the invention is one of the first through the third aspects, in which a support member is provided so as to be capable of assuming an opened state and a closed state by being rotated, and when in the opened state, the support member supports the recording target medium that has been set from the rear surface of the recording target medium, and the sheet material movement unit includes a configuration that slides the sheet material in accordance with the rotation of the support member.

According to this aspect, the sheet material movement unit includes a configuration that slides the sheet material in accordance with the rotation of the support member; accordingly, a dedicated driving source for the sheet material movement unit is unnecessary, thereby making it possible to reduce the cost of the apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
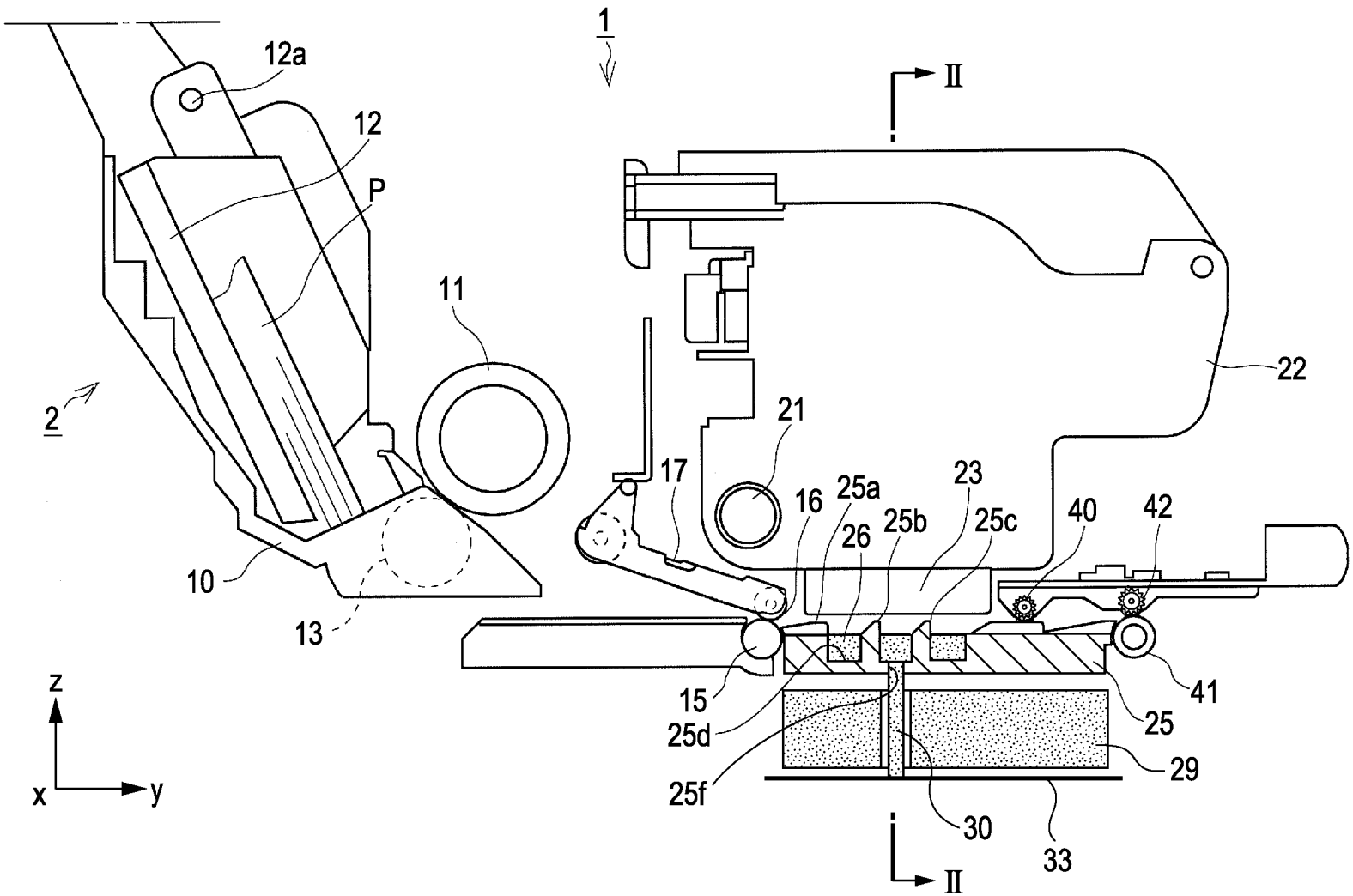
FIG. 1 is a cross-sectional side view schematically illustrating a paper transport path of an ink jet printer according to the invention.
Figure 2:
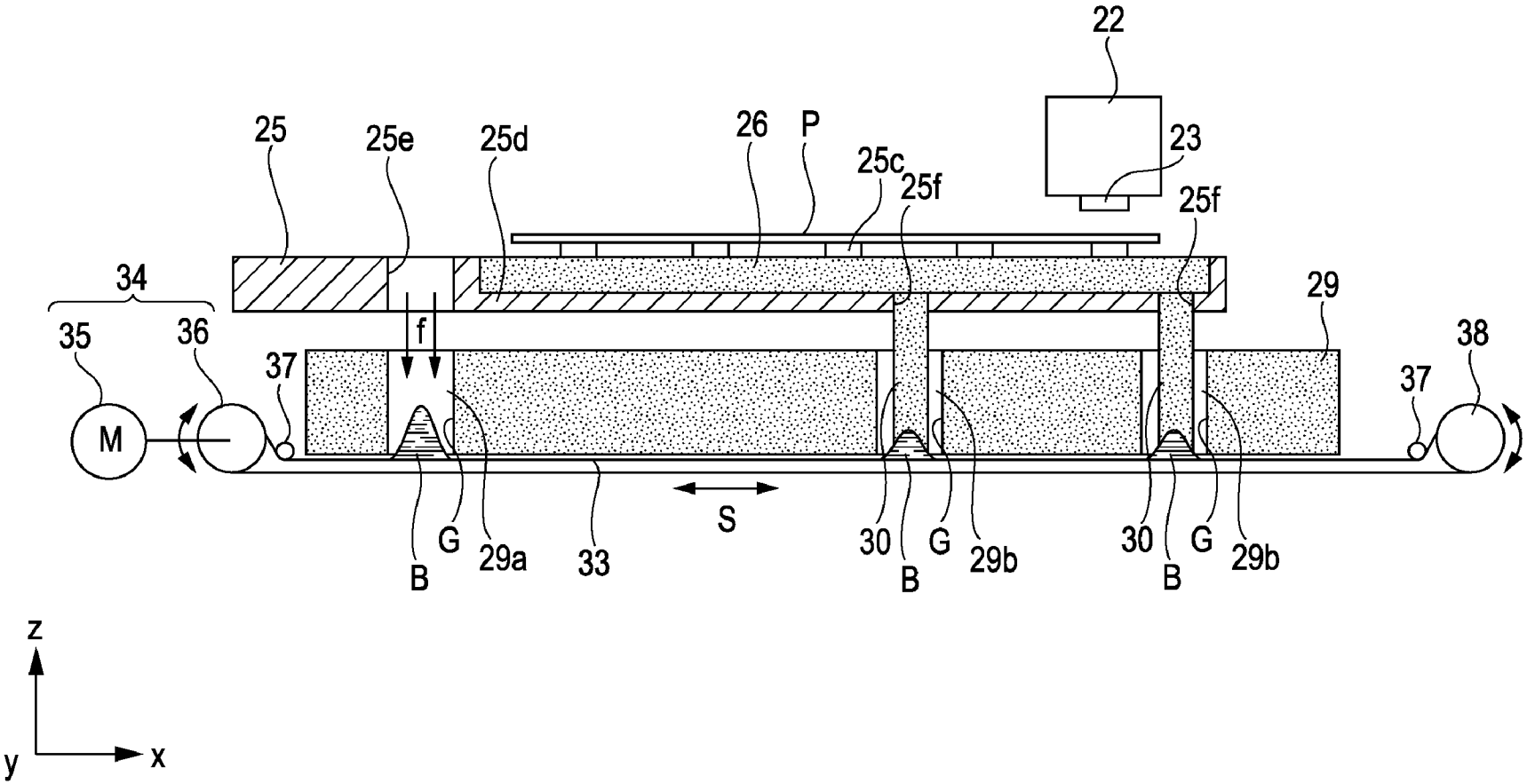
FIG. 2 is a cross-sectional view illustrating the primary elements of an ink jet printer according to the invention (as seen along the II-II line of FIG. 1).
Figure 3A:
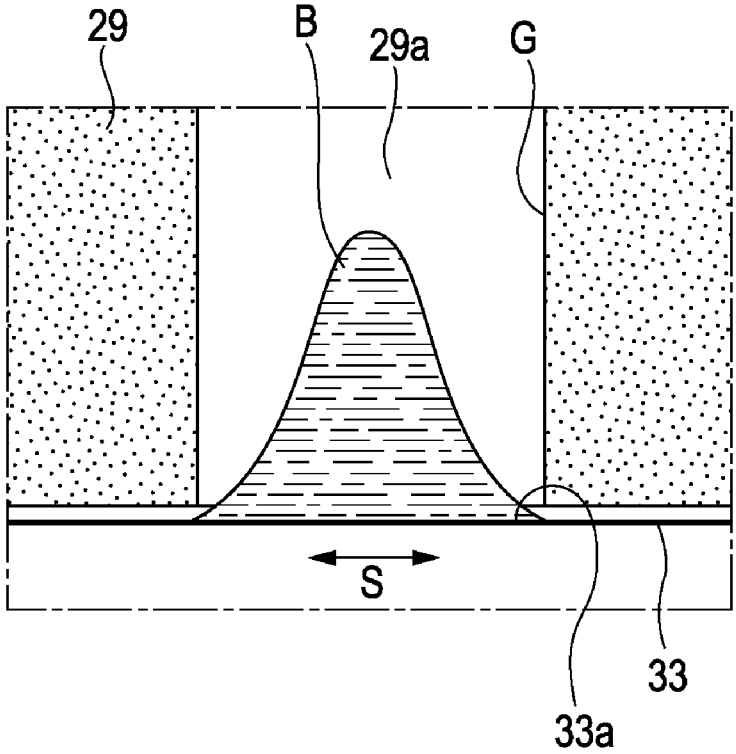
FIGS. 3A and 3B are partial enlargements of FIG. 2, illustrating movement and absorption of ink.
Figure 3B:
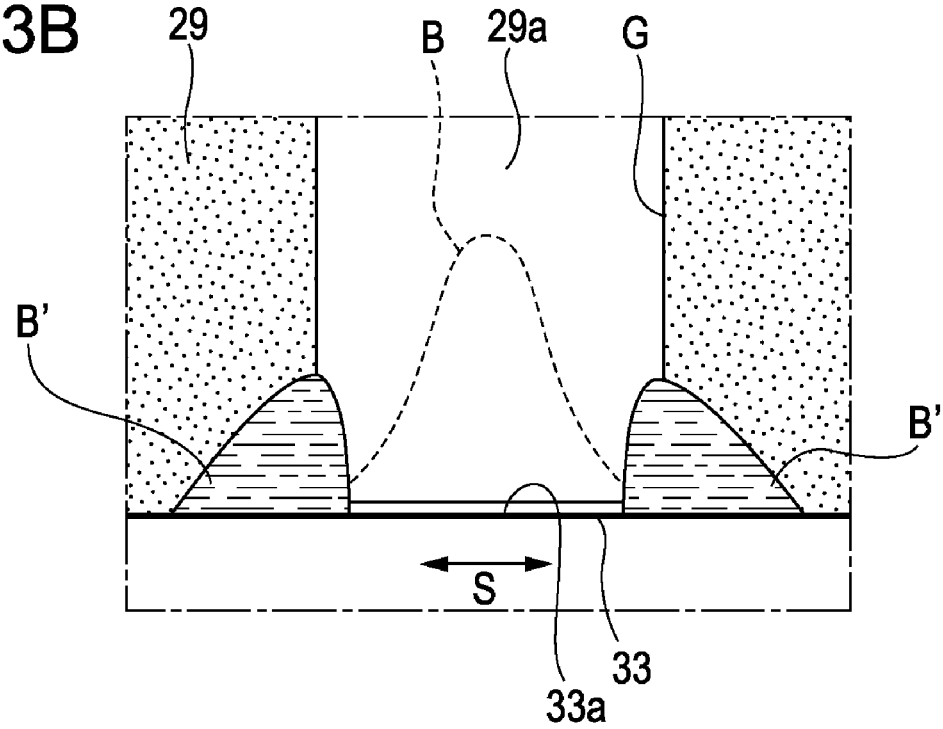

Hereinafter, embodiments of the invention will be described with reference to the drawings. FIG. 1 is a cross-sectional side view schematically illustrating a paper transport path of an ink jet printer 1 serving as a recording apparatus according to an embodiment of the invention; FIG. 2 is a cross-sectional view illustrating the primary elements of the ink jet printer 1 (as seen along the II-II line of FIG. 1); and FIGS. 3A and 3B are partial enlargements of FIG. 2, illustrating movement and absorption of ink.

Figure 4A:
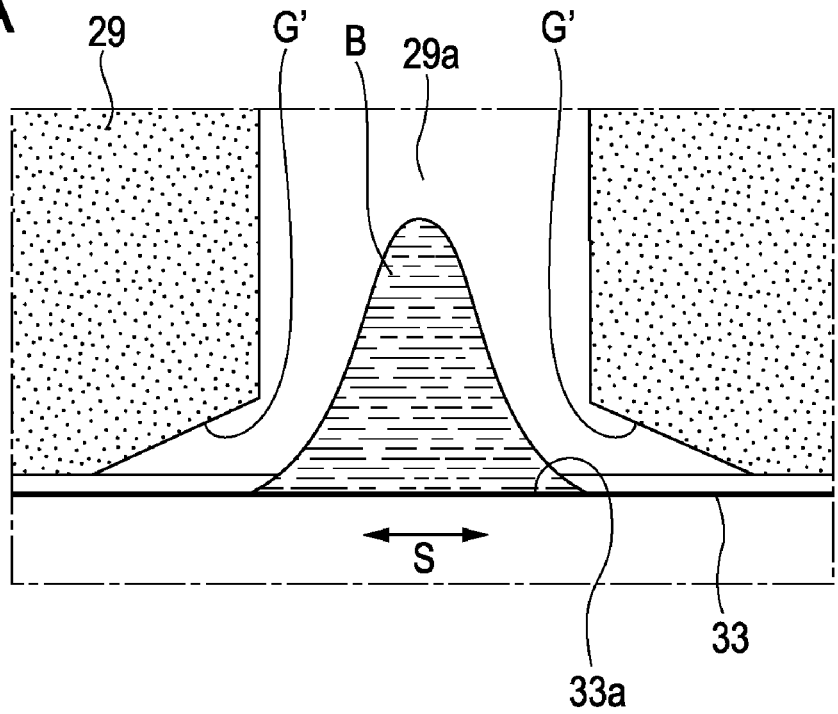
FIGS. 4A and 4B illustrate a variation on the embodiments illustrated in FIGS. 3A and 3B, illustrating movement and absorption of ink.
Figure 4B:
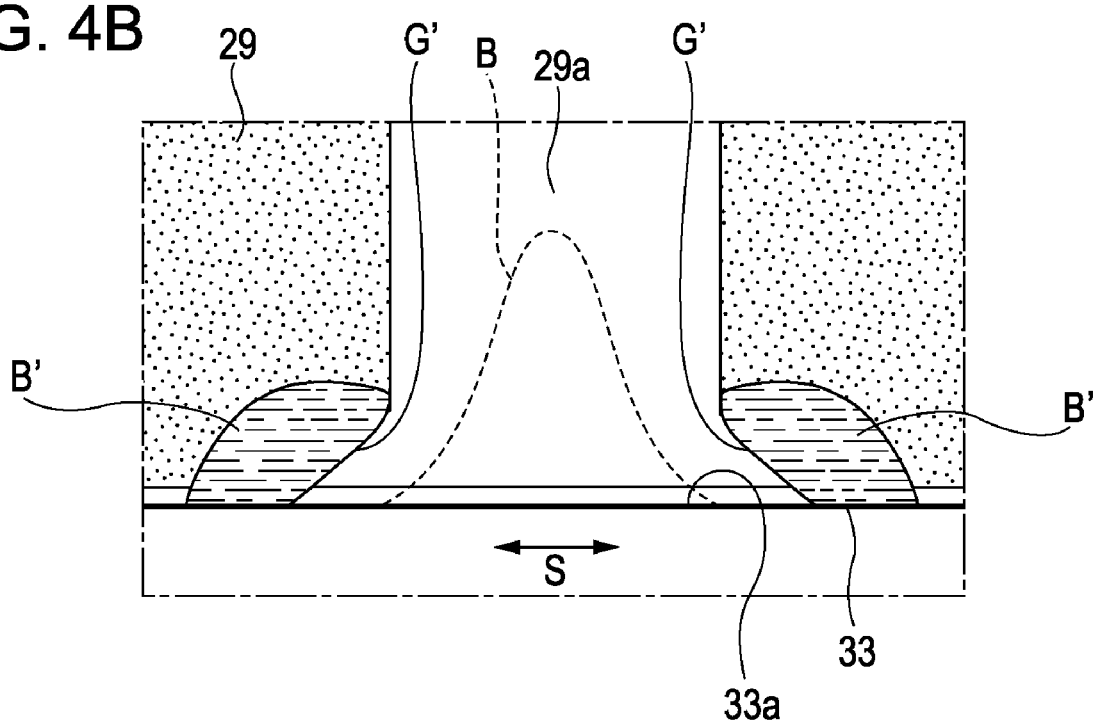
Figure 5:
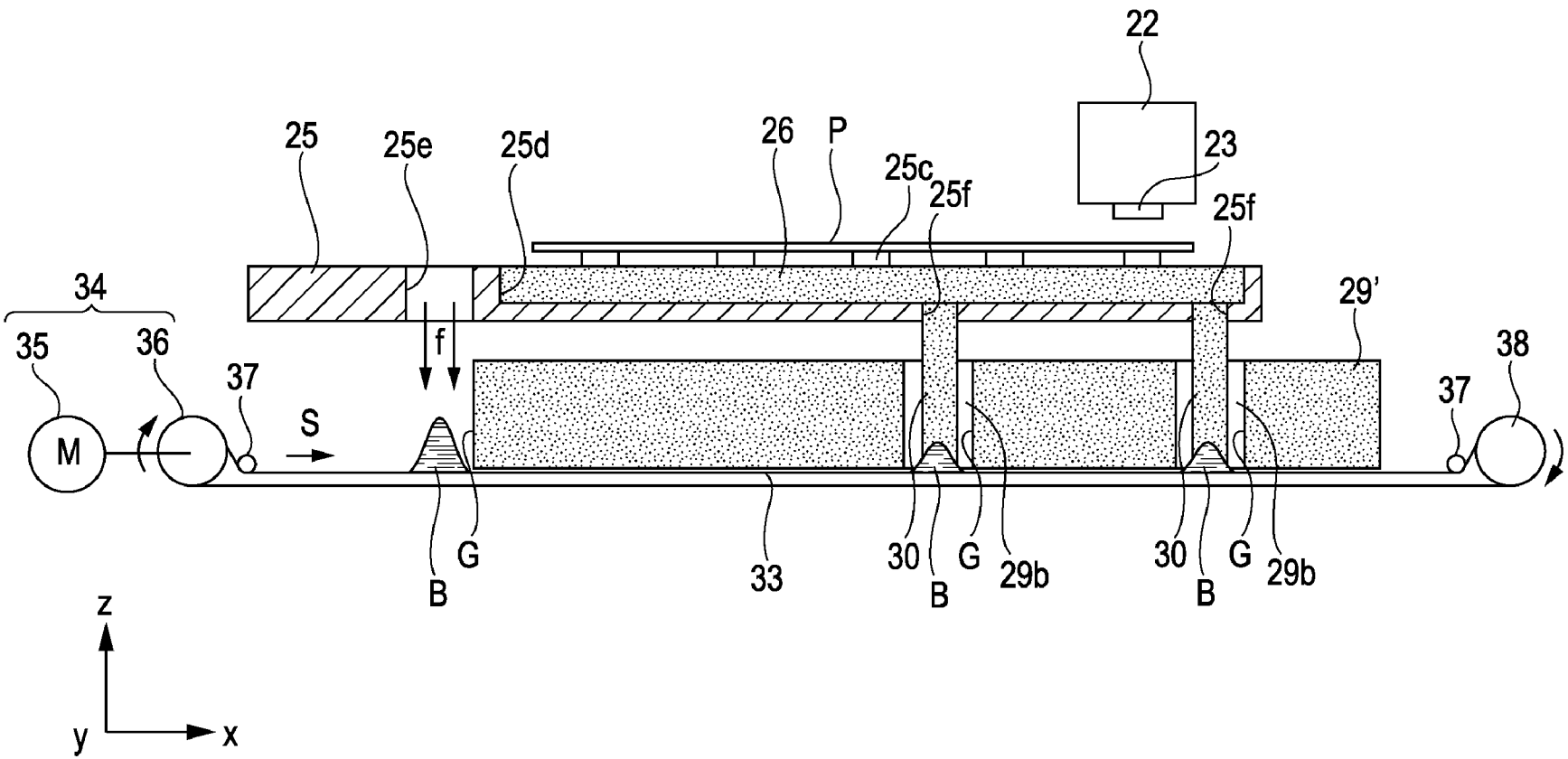
FIG. 5 illustrates a variation on the embodiment illustrated in FIG. 2, and illustrates another embodiment of an ink absorption material.
Figure 6:
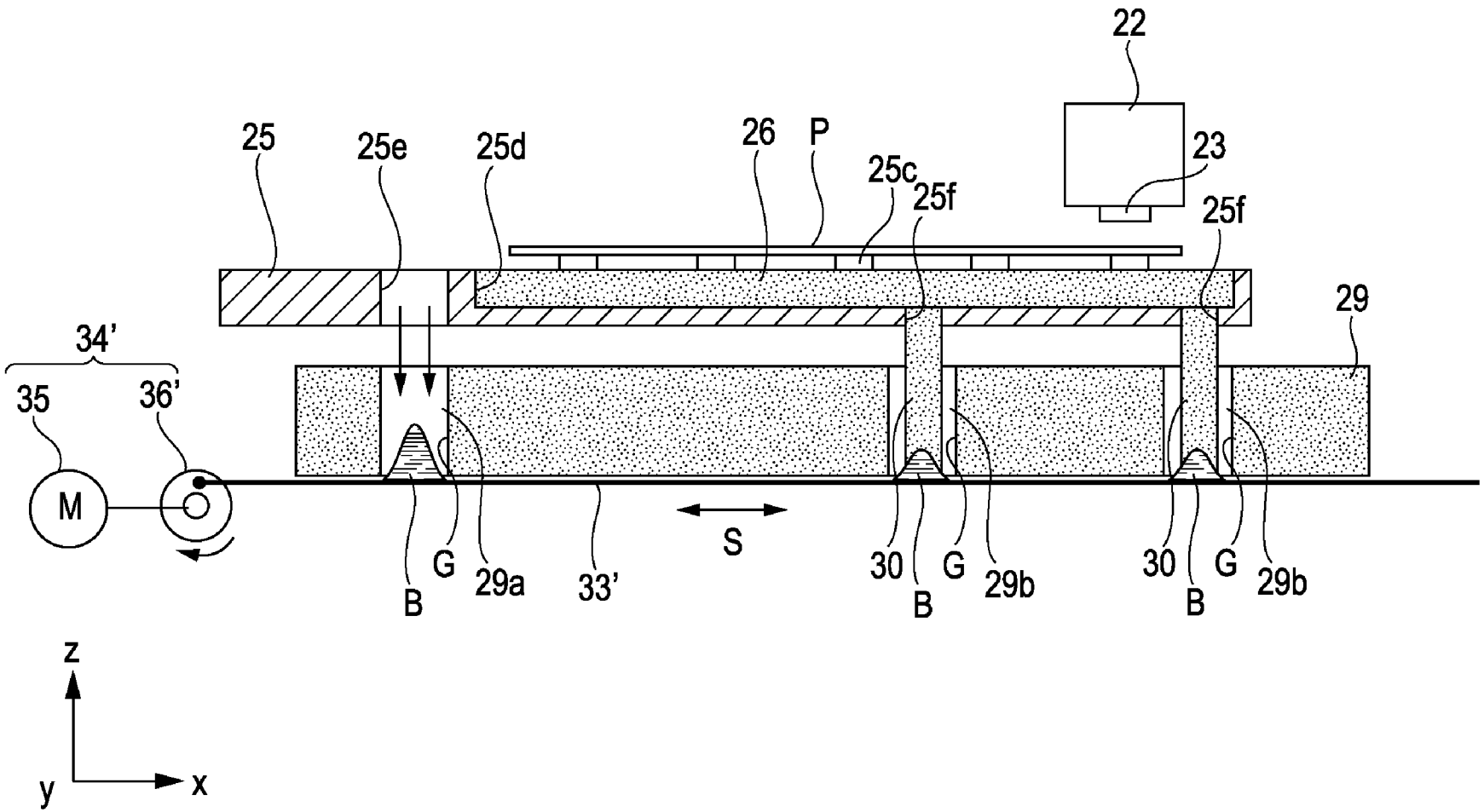
FIG. 6 illustrates a variation on the embodiment illustrated in FIG. 2, and illustrates another embodiment of a sheet material movement unit.
Figure 7:
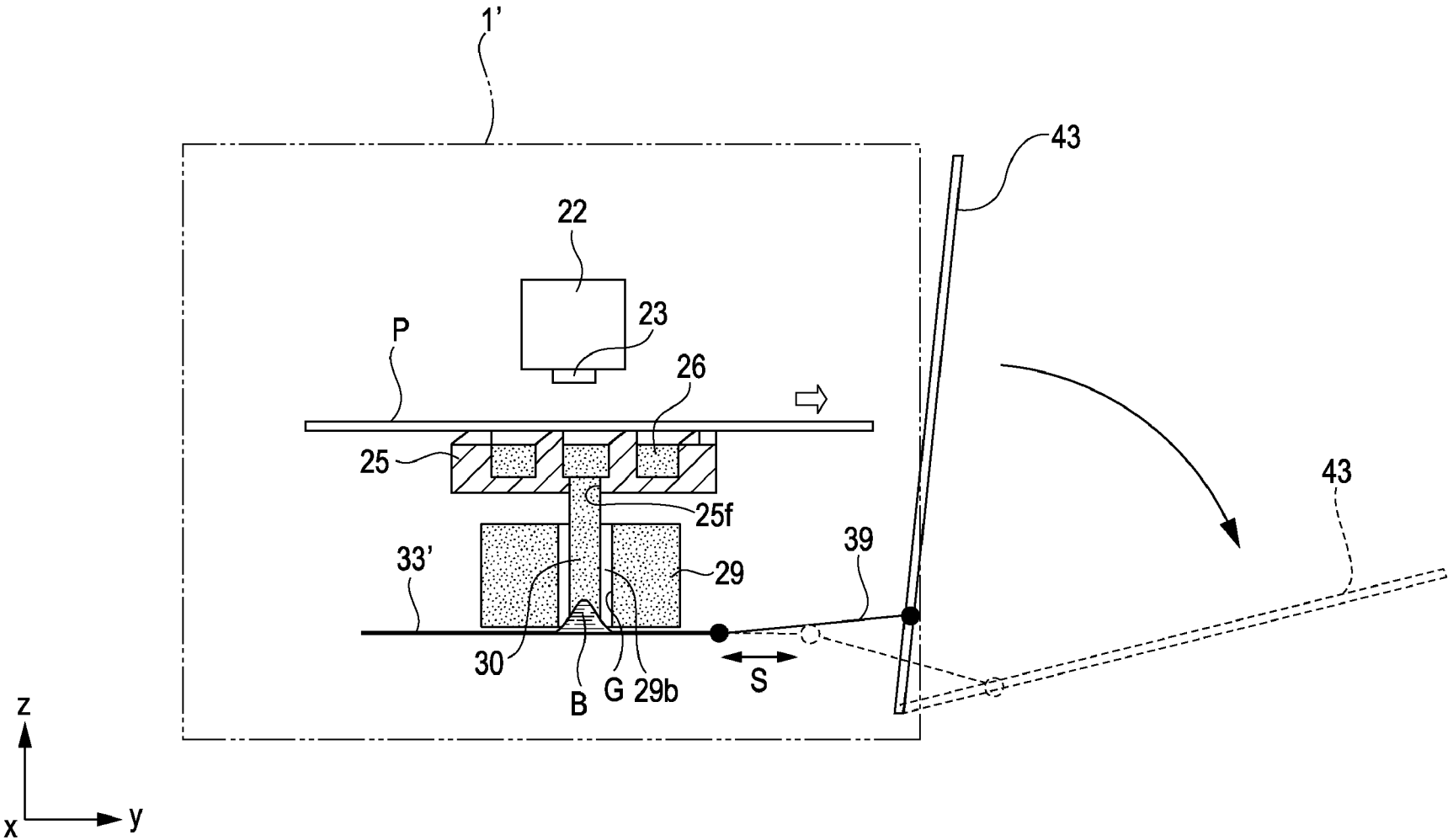
FIG. 7 is a schematic view illustrating the general configuration of an ink jet printer according to another embodiment of the invention (a diagram illustrating another embodiment of a sheet material movement unit).
Figure 8:
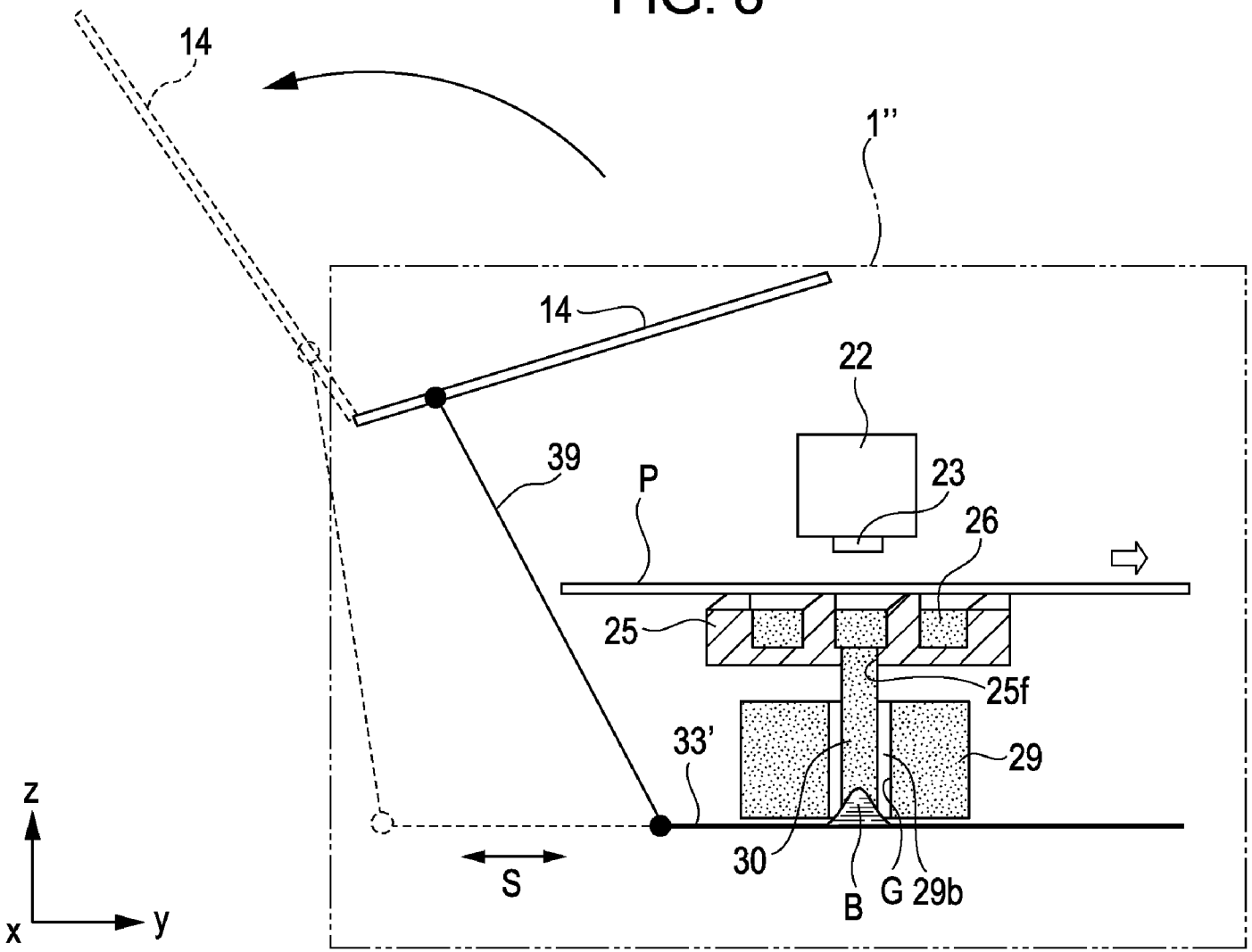
FIG. 8 is a schematic view illustrating the general configuration of an ink jet printer according to another embodiment of the invention (a diagram illustrating another embodiment of a sheet material movement unit).
Figure 9:
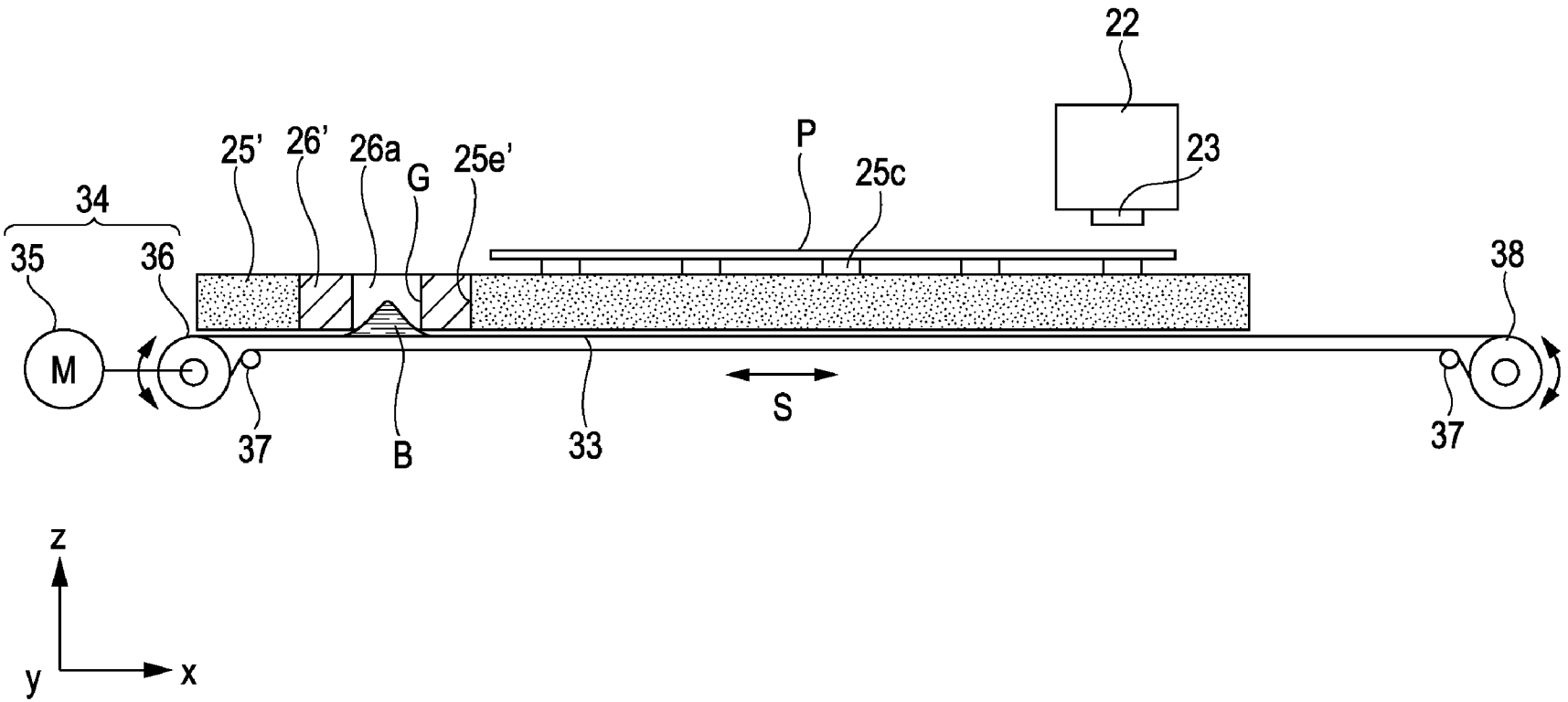
FIG. 9 is a cross-sectional view illustrating the primary elements of an ink jet printer according to another embodiment of the invention.

FIGS. 4A through 9 are diagrams illustrating other embodiments of the invention. Specifically, FIGS. 4A and 4B illustrate a variation on the embodiment illustrated in FIGS. 3A and 3B; FIG. 5 illustrates a variation on the embodiment illustrated in FIG. 2, and illustrates another embodiment of an ink absorption material; FIG. 6 illustrates a variation on the embodiment illustrated in FIG. 2, and illustrates another embodiment of a sheet material movement unit; FIG. 7 is a schematic view illustrating the general configuration of an ink jet printer 1' according to another embodiment of the invention (a diagram illustrating another embodiment of a sheet material movement unit); FIG. 8 is a schematic view illustrating the general configuration of an ink jet printer 1" according to another embodiment of the invention (a diagram illustrating another embodiment of a sheet material movement unit); and FIG. 9 is a cross-sectional view illustrating the primary elements of an ink jet printer according to another embodiment of the invention.

Note that FIGS. 1 through 9 are depicted using the x-y-z coordinate system, where the x-axis represents the width direction of the paper (the scanning direction of an ink jet recording head 23), the y-axis represents the transport direction of the paper, and the z-axis represents the height direction of the apparatus. Meanwhile, in the other embodiments illustrated in FIGS. 4A through 9, constituent elements that are the same as those illustrated in FIGS. 1 through 3B are given the same reference numerals, and further descriptions thereof will be omitted.

Hereinafter, an overview of the configuration of the ink jet printer 1 will first be given with reference to FIGS. 1 and 2. The ink jet printer 1 includes, in its rear portion, a paper supply apparatus 2, in which recording paper, serving as an example of a recording target medium (primarily single sheets of paper; called "paper P" hereinafter), can be set at an angled orientation.

The paper supply apparatus 2 is configured so that a paper supply roller 11 that supplies the paper P, a hopper 12 that supports the paper P in an angled orientation and that is capable of swinging about a swing axis 12*a*, and a retard roller 13 that separates the paper P are provided in a base frame 10.

The paper P, which is supplied in the downstream direction by the paper supply apparatus 2, is caught in a nip formed by a transport driving roller 15 that is rotationally driven by a motor (not shown in the diagrams) and a transport slave roller 16 that undergoes slave rotation by making contact with the transport driving roller 15, and is transported by the rotation of the transport driving roller 15 to a position opposite to the ink jet recording head 23.

Note that although the transport slave roller 16 is supported on the downstream end of an upper guide member 17 so as to be capable of free rotation, the rotational center thereof is set to be slightly on the downstream side than the rotational center of the transport driving roller 15. Accordingly, the advancement direction of the paper P, which is sent downstream by the transport driving roller 15 and the transport slave roller 16, is not parallel to the head surface of the ink jet recording head 23, but is instead slightly lower, or in other words, is positioned slightly toward a paper support member 25. This prevents the paper P from being raised off from the paper support member 25.

The ink jet recording head 23 and the paper support member 25 are provided downstream from the transport driving roller 15, in a manner in which the paper support member 25 is opposed to the ink jet recording head 23.

The ink jet recording head 23 is provided in the base area of a carriage 22, and the carriage 22 is driven by a driving motor (not shown) so as to move back and forth in the width direction of the paper while being guided by a carriage guide shaft 21 that extends in the width direction of the paper. Note that multiple independent ink cartridges for each color (not shown) are mounted in the carriage 22, and the configuration is such that ink is supplied to the ink jet recording head 23 from these ink cartridges.

As shown in FIG. 2, a first rib 25*a*, a second rib 25*b*, and a third rib 25*c* are formed in the surface of the paper support member 25 that opposes the ink jet recording head 23, and are formed in that order from the upstream side toward the downstream side. The distance between the paper P and the ink jet recording head 23 is regulated by the paper P being supported by these ribs.

Furthermore, a concave portion 25*d*, for discarding ink when ink is ejected onto a region that is outside of the edge (end) of the paper P, is formed. When executing what is known as borderless recording, where recording is carried out without providing a margin at the edges of the paper P, ink is ejected onto regions outside of the edges of the paper in a state in which an edge of the paper has been positioned above the concave portion 25*d*. Borderless recording is carried out onto the edges of the paper in this manner.

Note that at this time, ink that has been ejected onto the region outside of the leading edge of the paper (that is, ink that has been discarded) is captured by an ink absorption material 26 disposed in the concave portion 25*d*. The captured ink is then discharged downward from ink discharge holes 25*f* formed in the base area of the concave portion 25*d* (described later).

Meanwhile, a through-hole 25*e* is formed in the paper support member 25. The through-hole 25*e* is provided outside of the recording region in which recording is carried out onto the paper P, and is used when performing flushing operations for the ink jet recording head 23. The ink discarded at this time falls downward from the through-hole 25*e* as indicated by the arrows f, is stopped by a sheet material 33 (described later), and is then absorbed by an ink absorption material 29 provided below the paper support member 25 (also described later).

A supplementary roller 40, capable of free rotation and preventing the paper P from being raised off from the paper support member 25, is provided downstream from the ink jet recording head 23, and a discharge driving roller 41 driven by a motor (not shown) and a discharge slave roller 42 that undergoes slave rotation from coming into contact with the discharge driving roller 41 are provided downstream from the supplementary roller 40; the paper P onto which recording has been carried out is discharged to the exterior of the apparatus as a result of the rotation of the discharge driving roller 41.

The foregoing has described the general configuration of the ink jet printer 1, and the ink absorption material 29 disposed below the paper support member 25 and the sheet material 33 will be described hereinafter.

The ink absorption material 29 is formed of a material that is capable of absorbing ink that has been ejected from the ink jet recording head 23, and is formed of, for example, a sponge, a nonwoven fabric, or the like.

It is preferable for the sponge, the nonwoven fabric, or the like to have a characteristic of being unlikely to be affected by ink (that is, to have a high ink resistance), and if using a nonwoven fabric, various materials can be applied, such as polyester-based fibers, polypropylene-based fibers, polyethylene-based fibers, and so on. Note that it is likewise preferable for the ink absorption material 26 disposed in the paper support member 25 to have a high ink resistance, and a different material as that used for the ink absorption material 29, or the same material as that used for the ink absorption material 29, may be used for the ink absorption material 26.

In this embodiment, a single through-hole 29*a* and two through-holes 29*b* are formed in the ink absorption material 29. The through-hole 29*a* is formed in a location corresponding to the location in which the through-hole 25*e* formed in the paper support member 25 and used for flushing is formed, whereas the through-holes 29*b* are formed in locations corresponding to the respective locations in which the ink discharge holes 25*f* formed in the paper support member 25 are formed. Although the ink absorption material 29 is disposed alone in this embodiment, the ink absorption material 29 may be in a form in which it is housed within a box-shaped receptacle (a tray).

Next, the sheet material 33 is provided below the ink absorption material 29. The sheet material 33 is an endless sheet that is rotated around and stretched between a driving roller 36, which is rotationally driven by a motor 35, and a slave roller 38, which is capable of free rotation, and is capable of sliding in the direction of the arrow S shown in FIG. 2 as a result of the rotation of the driving roller 36. Note that the reference numeral 34 indicates a sheet material movement unit that includes the motor 35 and the driving roller 36, whereas the reference numeral 37 indicates a tension roller, capable of free rotation, that applies tension to the sheet material 33.

The sheet material 33 is disposed so as to almost make contact with the bottom surface of the ink absorption material 29 (however, for illustrative purposes, the drawings depict the sheet material 33 as being slightly distanced therefrom), and as shown in FIGS. 3A and 3B, the top surface of the sheet material 33, which is located below the through-hole 29*a*, configures an ink receiving surface 33*a* that receives ink.

FIG. 3A illustrates a state in which ink ejected through flushing operations of the ink jet recording head 23 has accumulated, and the reference numeral B indicates the accumulated ink. When the sheet material 33 slides (that is, moves back and forth) in the directions indicated by the arrow S in this state, the accumulated ink is pushed against the inner walls of the through-hole 29*a* (called "ink absorption surfaces G" hereinafter), as indicated by the reference numeral B' in FIG. 3B. Accordingly, the accumulated ink is rather forcefully caused to permeate into the ink absorption material 29.

Because the sheet material 33 is caused to initially receive the discarded ink and move toward the ink absorption material 29 (ink absorption surfaces G) in such a manner, it is preferable for the sheet material 33 to be formed of a material that is not ink-absorbent; thus the sheet material 33 can be formed of, for example, a polyester-based film sheet or the like.

As described thus far, the ink jet printer 1 includes: the sheet material 33 that configures the ink receiving surface 33*a* that receives ink discarded from the ink jet recording head 23; the ink absorption material 29 that absorbs ink, and includes the ink absorption surfaces G that form surfaces that intersect with the ink receiving surface 33*a*, and face the ink receiving surface 33*a*; and the sheet material movement unit 34 that causes the sheet material 33 to slide in the direction in which the ink receiving surface 33*a* approaches the ink absorption surfaces G, or in other words, the direction in which the accumulated ink B approaches the ink absorption surfaces G.

Accordingly, the permeability of the ink discarded from the ink jet recording head 23 into the ink absorption material 29 can be increased, thereby making it possible to obtain a favorable permeability even when inks of high viscosity are used, such as pigment-based inks. As a result, it is possible to prevent accumulated ink from reaching the back surface of the paper P.

Although the ink absorption surfaces G are surfaces (vertical surfaces) that are perpendicular to the sheet material 33 (ink receiving surface 33*a*) in the embodiment illustrated in FIGS. 3A and 3B, it should be noted that, as indicated by the reference numerals G' in FIGS. 4A and 4B, the ink absorption surfaces can also be formed as surfaces that intersect with the sheet material 33 (ink receiving surface 33*a*) at angles of less than 90° thereto. Forming the ink absorption surfaces in this manner makes it possible to increase the surface area of the ink absorption surfaces G', which in turn makes it possible to increase the ink absorption rate when sliding the sheet material 33.

Incidentally, although the sheet material 33 directly receives ink from the ink jet recording head 23 within the through-hole 29*a* formed in the ink absorption material 29, the ink may instead be received indirectly, via another member. The reference numerals 30 in FIG. 2 indicate ink conduction members that connect the ink discharge holes 25*f* to the sheet material 33 (ink receiving surface 33*a*), and the sheet material 33 indirectly receives the ink via the ink conduction members 30 within the through-holes 29*b* formed in the ink absorption material 29.

The lower end of each ink conduction member 30 makes contact with the sheet material 33, and when the sheet material 33 slides (moves back and forth) in the direction of the arrow S, ink that has accumulated at the lower end of each ink conduction member 30 leaks out to the outside thereof as a result of the sliding operations. That ink is then pressed against the ink absorption surfaces G, which form the inner walls of the through-holes 29*b*, and is thus caused to permeate into the ink absorption material 29. Accordingly, as a result, ink that has been conducted from the ink absorption material 26 disposed in the paper support member 25 to the sheet material 33 via the ink conduction member 30 can be smoothly absorbed into the ink absorption material 29.

Note that the movement of the sheet material 33 may be in the back-and-forth direction, as indicated by the arrow S in FIGS. 2, 3A and 3B, or may be in a constant direction. In addition, the driving control for the sheet material 33 performed by the sheet material movement unit 34 may be carried out intermittently every set amount of time or continuously for a set amount of time; alternatively, these two options may be carried out in a mixed manner.

In another embodiment, illustrated in FIG. 5, the through-hole 29*a* (see FIG. 2) is not formed in an ink absorption material 29' provided below the paper support member 25, in a location below the through-hole 25*e* formed in the paper support member 25 and used for flushing operations; a side surface of the ink absorption material 29' configures the ink absorption surface G. When using such a configuration, it is preferable for the sheet material 33 to be driven in a constant direction, as indicated by the arrow S. Note that according to this configuration, the level of freedom with respect to the shape/structure of the ink absorption material 29' can be increased.

In addition, ensuring that the period in which the sheet material 33 is slid occurs, for example, quickly after carrying out borderless recording onto the paper P makes it possible to prevent the ink from hardening and cause the ink to be absorbed into the ink absorption material 29 in a smooth manner. Alternatively, in the case where flushing operations have been carried out through the through-hole 25*e*, causing the sheet material movement unit 34 to operate quickly after the flushing operations likewise makes it possible to prevent the ink from hardening and cause the ink to be absorbed into the ink absorption material 29 in a smooth manner. The stated operation can be executed at various different times, such as when the ink jet printer 1 is powered off or the like.

The embodiment described thus far is merely one example, and various further variations thereupon are possible. For example, in the foregoing embodiment, an endless sheet is used as the sheet material 33, and the sheet material 33 is rotated around and stretched between the driving roller 36 and the slave roller 38.

As opposed to this, with a sheet material movement unit 34' illustrated in FIG. 6, an ended sheet (indicated by the reference numeral 33') is used, and one end thereof is anchored to a location distanced from the rotational center of a driving roller 36'. Through this, a set amount of back-and-forth movement of the sheet material 33' can easily be realized simply by rotating the driving roller 36' in a constant direction.

Next, although the motor 35 is used as the sheet material movement unit in the foregoing embodiment, movable members of which the recording apparatus is configured can be used as the sheet material movement unit. This will be described hereinafter with reference to FIGS. 7 and 8.

An ink jet printer 1' illustrated in FIG. 7 includes, in its front surface, a paper discharge tray 43 that receives the paper P onto which recording is performed and which is then discharged. The paper discharge tray 43 is configured so as to be switchable between a closed state (the solid line in FIG. 7) and an opened state (the dotted line in FIG. 7) by being rotated, and is provided so that a user can change its orientation as necessary.

The sheet material 33' is connected to the paper discharge tray 43 by a connection rod 39, and as a result, the sheet material 33' slides as the paper discharge tray 43 undergoes rotational movement. According to this configuration, it is not necessary to provide a dedicated driving source for the sheet material movement unit, which makes it possible to reduce the cost of the apparatus.

Similarly, an ink jet printer 1" illustrated in FIG. 8 includes, in its rear area, a support member 14 that supports the paper P that has been set in a paper supply apparatus from its rear surface. The support member 14 is configured so as to be switchable between a closed state (the solid line in FIG. 8) and an in-use state (the dotted line in FIG. 8) by being rotated, and is provided so that a user can change its orientation as necessary.

The sheet material 33' is connected to the support member 14 by the connection rod 39, and as a result, the sheet material 33' slides as the support member 14 undergoes rotational movement. As with the embodiment illustrated in FIG. 6, according to this configuration, it is not necessary to provide a dedicated driving source for the sheet material movement unit, which makes it possible to reduce the cost of the apparatus. Furthermore, if a constituent element that is displaced or changes its orientation through user operations is present in the apparatus, the configuration can be such that the sheet material 33' slides in accordance therewith.

In addition, although the sheet material 33 or the sheet material 33' is applied to the ink absorption material 29 disposed below the paper support member 25 in the foregoing embodiment, the sheet materials can also be applied to the ink absorption material 26 provided in the paper support member 25. In FIG. 9, the reference numeral 25' indicates a paper support member; a through-hole **25*e*' for discarding ink during flushing operations is formed in the paper support member 25', and an ink absorption material 26' is disposed on the inner side of the through-hole 25*e'***.

A through-hole **26*a* is formed in the ink absorption material 26', and the inner walls of the through-hole 26*a* configure the ink absorption surfaces G; accumulated ink B is absorbed by the ink absorption material 26' as a result of the sliding of the sheet material 33. In this manner, the sheet material 33** can be applied in a variety of locations.

What is claimed is:

1. A recording apparatus comprising:

a recording head that ejects ink;

a sheet material that receives ink discarded from the recording head directly from the recording head or indirectly via another member;

an ink absorption material that absorbs ink, and includes an ink absorption surface that forms a surface that intersects with an ink receiving surface of the sheet material that receives ink, and faces the ink receiving surface;

a sheet material movement unit that causes the sheet material to slide in at least a direction in which the ink receiving surface approaches the ink absorption surface; and a through-hole that passes through the ink absorption material in the thickness direction thereof is formed in the ink absorption material;

wherein the ink absorption surface is formed by an inner circumferential surface of the through-hole, and the ink receiving surface of the sheet material is a part of the sheet material corresponding to the through-hole.

2. The recording apparatus according to claim 1, further comprising:

a recording target medium support member that is disposed opposite to the recording head and that regulates the distance between a recording target medium and the recording head by supporting the recording target medium, wherein a concave portion into which ink is discarded and an ink discharge hole that is formed in the bottom surface of the concave portion and that discharges ink downward are formed in the recording target medium support member;

the ink absorption material and the sheet material are disposed below the recording target medium support member; and the ink receiving surface of the sheet material and the ink discharge hole are connected by an ink conduction member that conducts ink.

3. The recording apparatus according to claim 1, wherein the sheet material movement unit includes a configuration that slides the sheet material using a motor.

4. The recording apparatus according to claim 1, further comprising:

a tray is provided so as to be capable of assuming an opened state and a closed state by being rotated, and when in the opened state, the tray receives the recording target medium onto which recording has been performed and that has been discharged, wherein the sheet material movement unit includes a configuration that slides the sheet material in accordance with the rotation of the tray.

5. The recording apparatus according to claim 1, further comprising:

a support member is provided so as to be capable of assuming an opened state and a closed state by being rotated, and when in the opened state, the support member supports the recording target medium that has been set from the rear surface of the recording target medium, wherein the sheet material movement unit includes a configuration that slides the sheet material in accordance with the rotation of the support member.

* * * * *